US007669851B2

(12) United States Patent
Blake

(10) Patent No.: US 7,669,851 B2
(45) Date of Patent: Mar. 2, 2010

(54) PLAYING CARD VIEWING DEVICE

(76) Inventor: Al Blake, c/o Schweitzer Cornman Gross & Bondell LLP, 292 Madison Ave., 19th Floor, New York, NY (US) 10017

( * ) Notice: Subject to any disclaimer, the term of this patent is extended or adjusted under 35 U.S.C. 154(b) by 0 days.

(21) Appl. No.: 12/164,700

(22) Filed: Jun. 30, 2008

(65) Prior Publication Data

US 2009/0322025 A1 Dec. 31, 2009

(51) Int. Cl.
*A63F 1/10* (2006.01)

(52) U.S. Cl. ..... 273/148 R; 273/150; 273/148 A; 273/309

(58) Field of Classification Search ..... 273/148 A, 273/309, 148 R, 149 R, 150, 151
See application file for complete search history.

(56) References Cited

U.S. PATENT DOCUMENTS

| | | | | |
|---|---|---|---|---|
| 3,742,616 | A | 7/1973 | Heller | |
| 4,146,229 | A | 3/1979 | Morse | |
| 5,039,102 | A | 8/1991 | Miller | |
| 5,312,104 | A | 5/1994 | Miller | |
| 5,362,053 | A | 11/1994 | Miller | |
| 5,632,483 | A * | 5/1997 | Garczynski et al. | 273/148 R |
| 5,669,816 | A | 9/1997 | Garczynski et al. | |
| 5,681,039 | A | 10/1997 | Miller | |
| 7,158,096 | B1 | 1/2007 | Spitzer | |
| 7,360,762 | B2 | 4/2008 | Itagaki et al. | |
| 7,478,813 | B1 * | 1/2009 | Hofferber et al. | 273/148 A |
| 2003/0052448 | A1 * | 3/2003 | Bertrand | 273/148 R |
| 2006/0163808 | A1 * | 7/2006 | Belill | 273/150 |
| 2008/0143049 | A1 * | 6/2008 | McLaughlin | 273/150 |

* cited by examiner

*Primary Examiner*—Benjamin H Layno
(74) *Attorney, Agent, or Firm*—Ladas & Parry LLP

(57) ABSTRACT

A card viewing device has a housing having opposed first and second side walls, opposed front and rear walls, a card-accepting entranceway in a lower portion of the front wall, a viewing aperture in an upper portion of the rear wall, and an optical system within the housing for projecting an image of a portion of at least one card received within the device through the entranceway through the viewing window for observation by a user. The device is particularly adapted to allow private viewing of playing cards lying face-down on a playing surface, allowing the user of the device to view the card faces without lifting the cards off the playing surface or otherwise making them viewable by others.

14 Claims, 4 Drawing Sheets

PLAYING CARD VIEWING DEVICE

The present invention relates to a new and improved device to facilitate the viewing the unexposed face of a playing card or like object placed face down on a playing surface.

BACKGROUND OF THE INVENTION

Many card games provide that at least a portion of the cards or "hand" dealt to a player be dealt face-down such that they remain unexposed to the other players. While often such cards are held in the hand of the player, certain games, including blackjack and poker, particularly when played in a casino venue, require that the cards remain face down on the table. In order to prevent others from viewing them, such "down" cards are typically inspected by the player by lifting a corner or edge of the card(s), the player lowering and angling his head to view the exposed indicia on the lifted portion of the card. For those with poor eyesight or with difficulties in positioning their head in an appropriate position to view the card, it is difficult to see the indicia and thus is an impediment to enjoyment of, or even participation in, the game.

While there exist other devices that provide assistance or means for viewing playing cards, they either require that the cards be lifted off the table to be placed on or in the device, such as that disclosed in U.S. Pat. No. 4,146,229 to Morse, or are integrated into the playing surface and thus are not portable, such as that of U.S. Pat. No. 5,039,102.

It is accordingly the purpose of the present invention to provide a playing card viewing device which allows a player to comfortably view, in a private manner, the indicia of a "down" card without substantially moving his or her head from its normal position. A further purpose of the present invention is to provide such a viewing device that is highly portable, simple to use, and which can be used with conventional cards, and does not require any modification to the cards or a playing surface on which the cards are placed. Only an edge of the card or cards is slightly lifted off the table.

BRIEF DESCRIPTION OF THE INVENTION

In accordance with the foregoing, a playing card viewing device constructed in accordance with the present invention comprises a relatively small housing, preferably in the form of a cube, having a reception aperture on a front side to receive an edge portion of a playing card placed face down on the playing surface. The receiving aperture has an angled surface that causes the inserted edge of the card to be raised upward as it is inserted into the device. An optical system within the box transmits an image of the inserted card edge upwardly and outwardly through a viewing window on an opposite side of the housing. The image is projected such that it may be seen by the user without substantially changing his head position or lowering it to view the card when exposed in the normal manner. The viewing window may be recessed within the housing and may be further constructed to limit its field of view and thus increase the difficulty for other players to view the card image. The device may be provided with internal illumination means to assist viewing the card image and may also include means to invert or rotate the apparent orientation of the card image to facilitate identification of the card by the viewer.

BRIEF DESCRIPTION OF THE DRAWINGS

A fuller understanding of the present invention will be acquired upon review of the following detailed description of preferred but nonetheless illustrative embodiments of the invention when reviewed in association with the annexed drawings, wherein.

DETAILED DESCRIPTION OF THE INVENTION

Figure 1:
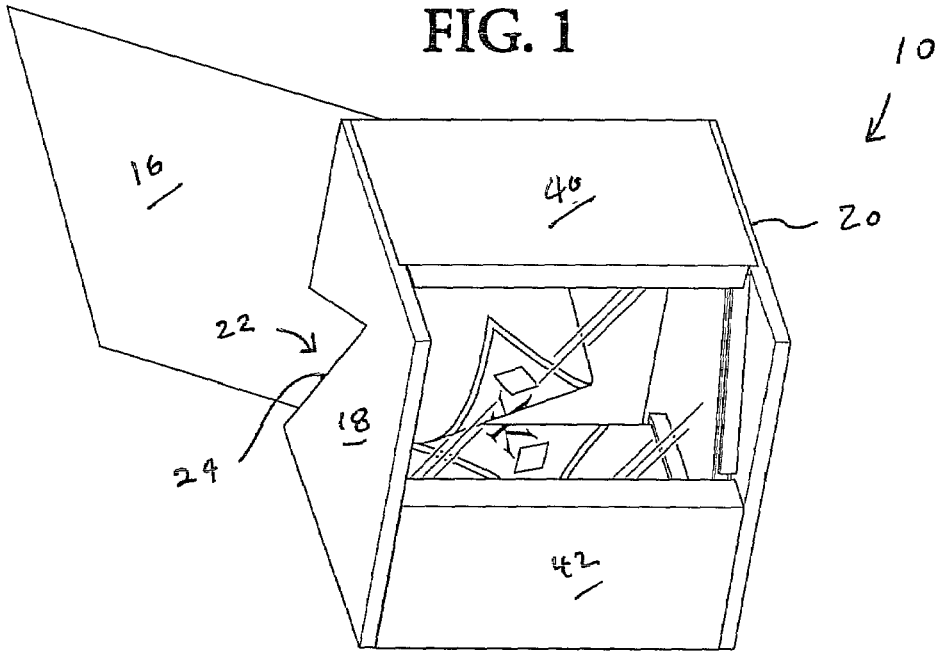
FIG. 1 is a perspective view of the invention in use.
Figure 3:
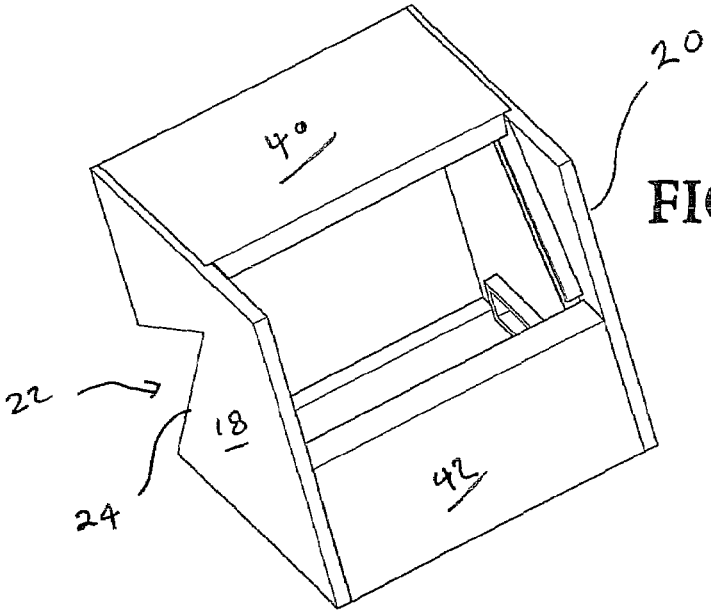
FIG. 3 is a perspective view similar to that of FIG. 1 further illustrating the interior construction of the housing.
Figure 4:
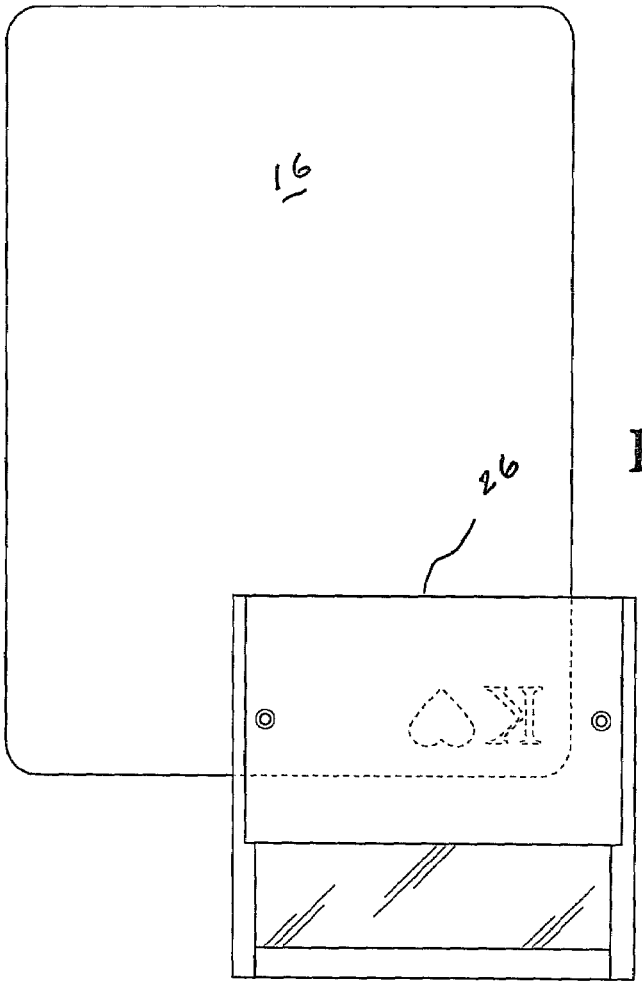
FIG. 4 is a top plan view of the invention with a card inserted.

With initial consideration of FIGS. 1 and 3, card viewer 10 of the present invention may be constructed with a housing in the general form of a cube, which may be approximately 1½ inches in height, width and depth. Such a small size permits convenient transport by the user and orientation in use on a variety of playing surfaces. The housing includes a card entrance aperture 12 through a front side and a viewing aperture 14 positioned at last partially through an opposite rear side. An edge portion, such as the corner portion shown, of a playing card 16 is inserted into the entrance aperture 12, and an image of its face-down face portion within the device may be seen by the user by looking through window 38 recessed within viewing aperture 14. A plurality of cards can be viewed simultaneously by slightly spreading or fanning the cards to expose corresponding corner portions as a group.

Card aperture 12 is bounded by v-shaped cutout 22 in housing first sidewall 18. The angled lower edge 24 of the cutout, which extends upwardly from the bottom corner of the housing, provides a ramp against which the lower surface of the card 16 rests, whereby the inserted edge of the card is raised along the ramp surface as it is inserted. The ramp surface 24 may be at an angle of about 50° to the horizontal. The card entrance aperture extends across front wall 26 of the viewer in the form of a rectangular cutout portion whose height is bounded by the open end of the v-shape sidewall opening 22. Because the angled surface 24 of the sidewall does not extend across the width of the rectangular front wall opening, the inserted card portion is fully exposed to the internal optical system, while the inserted card 16 has sufficient flexibility to allow the inserted portion to be raised sufficiently across its inserted width for viewing solely by virtue of the contact of the card with the angled sidewall surface 24. Housing bottom wall 54 may be provided with ramp surface edge 56, however, to prevent binding of the card edge as it is inserted. The portion of opposed second sidewall 20 corresponding to the cutout portion 22 of the first sidewall may be solid, thereby providing a guide surface for a side of the card, and assisting in orienting the card such that a corner of the card, which typically bears identifying indicia, is correctly positioned during insertion into the device for viewing. Alternatively the second sidewall may have a corresponding v-shaped opening, allowing any portion of a card edge to be oriented as desired in the entrance aperture, thus accommodating indicia, for example, on either a right or left corner of a card and allowing card insertion from either side of the device.

Figure 2:
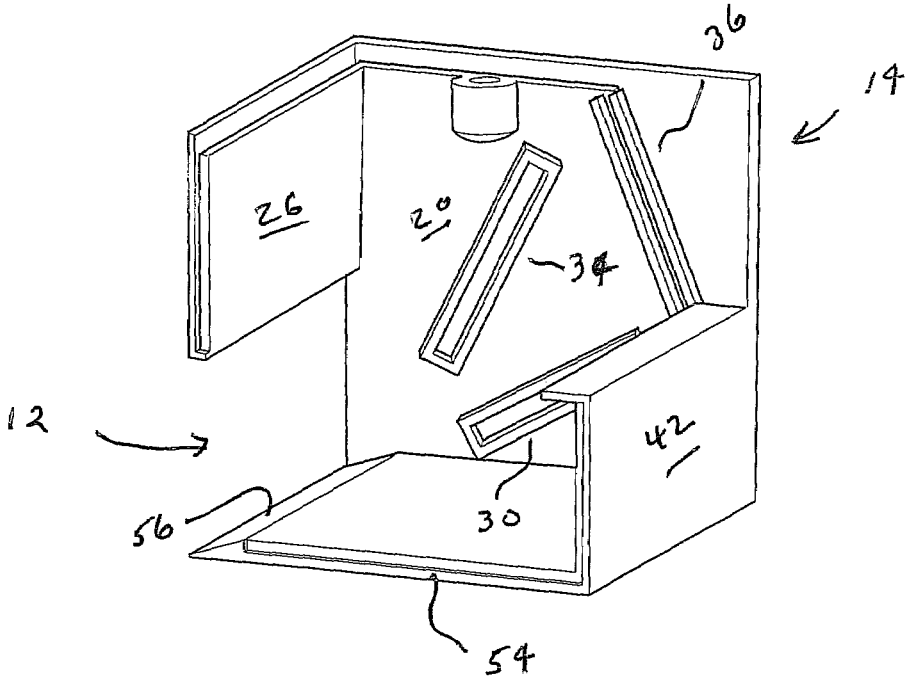
FIG. 2 is a perspective cut-away view of the invention.
Figure 5:
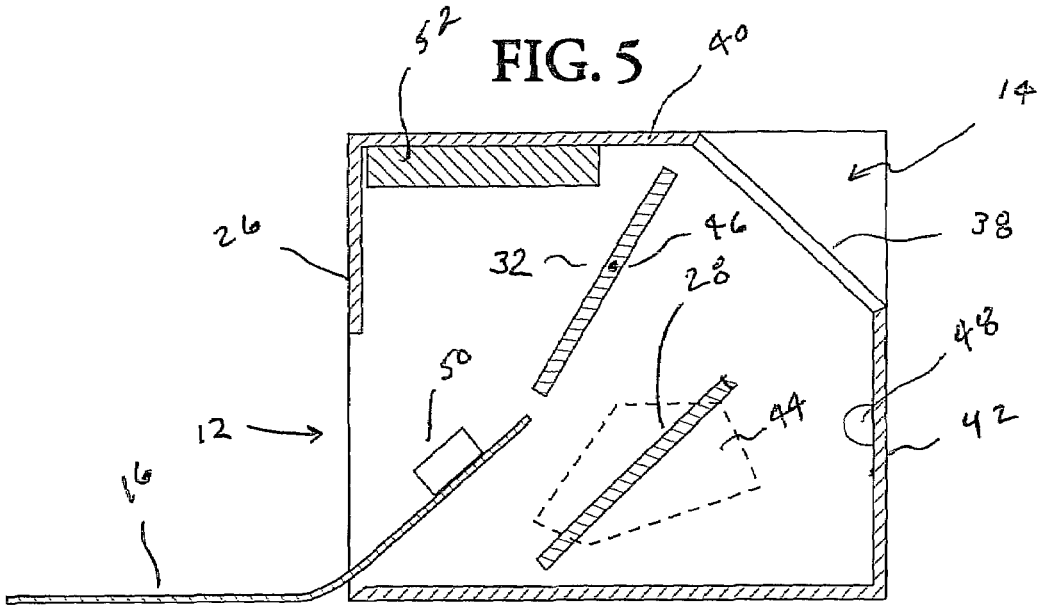
FIG. 5 is a side sectional elevation view.

The device's optical system may include a first mirror 28 mounted within the lower rear portion of the housing, beyond the inserted card portion and typically at an angle of approximately 60° to the horizontal, as depicted in FIG. 5. The mirror may be supported by opposed box-like bosses 30, as seen in FIG. 2, on the sidewalls 18 and 20. A second mirror 32 is mounted above and forward of first mirror 28, and is likewise supported by bosses 34 at an angle of about 75° to the horizontal. Viewing window 38, as shown in FIG. 5, is positioned between the sidewalls 18 and 20 by opposed pairs of parallel ledges 36 spaced to accommodate the viewing window therebetween. Viewing window 38 may be of clear or tinted glass or plastic, and may advantageously be of a construction that limits or minimizes transparency as the viewing angle increases, such as incorporated in computer monitor privacy filters, thus minimizing the effective lateral (off axis) viewing angle to accommodate only the user looking directly into the window. The abutting upper rear corner portions of both top wall 40 and rear wall 42 are removed to form the viewing aperture 14 into which the window 38 is placed, while the upper rear corners of the sidewalls 18 and 20 form a pair of protective and blocking shoulders projecting beyond the viewing window 38.

As further understood with reference to FIG. 5, the angle of inserted card 16, combined with the positioning of mirrors 28 and 32, allows an image of the lower surface of the inserted portion of the card to be reflected through the glass viewing window 38. The use of two mirrors causes double inversion of the reflected image, such that the image appears through the viewing window in its original head-up orientation. The user need not reposition his head at a reduced angle to view the card image.

In lieu of mirrors 28 and 32 the optical system may include a prism 44, shown in phantom in FIG. 5, positioned within the viewer housing to direct the image of the card through the viewing window and to further alter the orientation of the image through internal reflections to provide an upright projection of the card. Adjustment means, as exemplified by rotation axis 46 associated with second mirror 32, may be provided to allow adjustment of an element of the optical system, including prism 44, to allow adjustment of the path of travel of the image to direct the image appropriately through the viewing window 38 to further accommodate, for example, differing heights of a viewer with respect to the surface upon which the viewing device is placed. Rotation axis 46 may comprise a rod extending through a sidewall of the device to be manually rotated by the user to align the mirror appropriately for his or her best card viewing.

To further assist in observing the card indicia, light source 48 may be provided within the viewer housing. Preferably, the light source 48 is a small light-emitting diode, as known in the art. A switch 50 may be provided which is activated by the inserted card 16. Circuitry means 52, which may comprise appropriate components as known in the art on a printed circuit board, may be mounted to the inner surface of top wall 40, and may include the necessary light power source, such as a small battery, as well as associated components to provide, for example, timed activation of light source 48 only for a short duration when the card is inserted. Alternatively, other switching means, such as a user-controlled switch for the light, may be provided.

Figure 6:
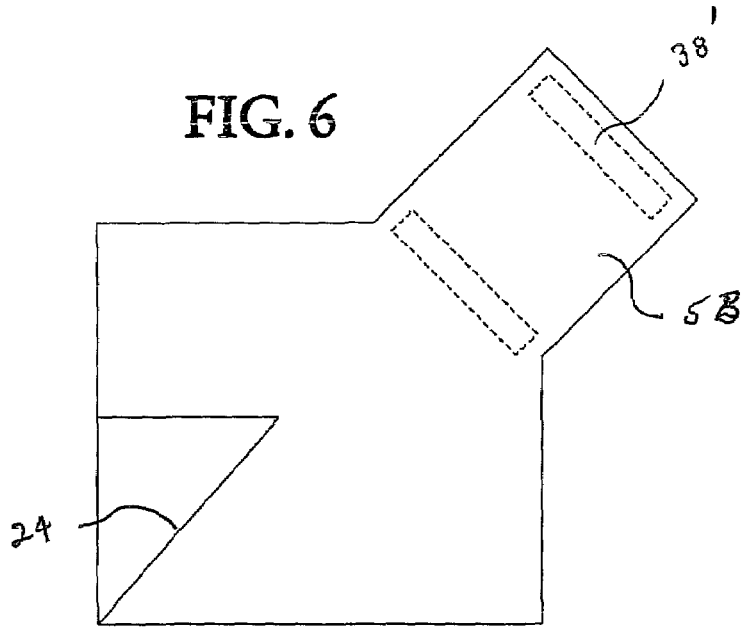
FIG. 6 is a side elevation view of an alternative construction.

FIG. 6 depicts an alternative construction for the housing, in which a tube-like collar 58 extends upwardly from and about viewing window 38. This construction may provide additional privacy, increasing the difficulty of adjacent players of looking into through the window to see the indicia on the inserted card. Window 38 may alternatively be located at the top end of the collar, as shown at 38'.

Figure 7:
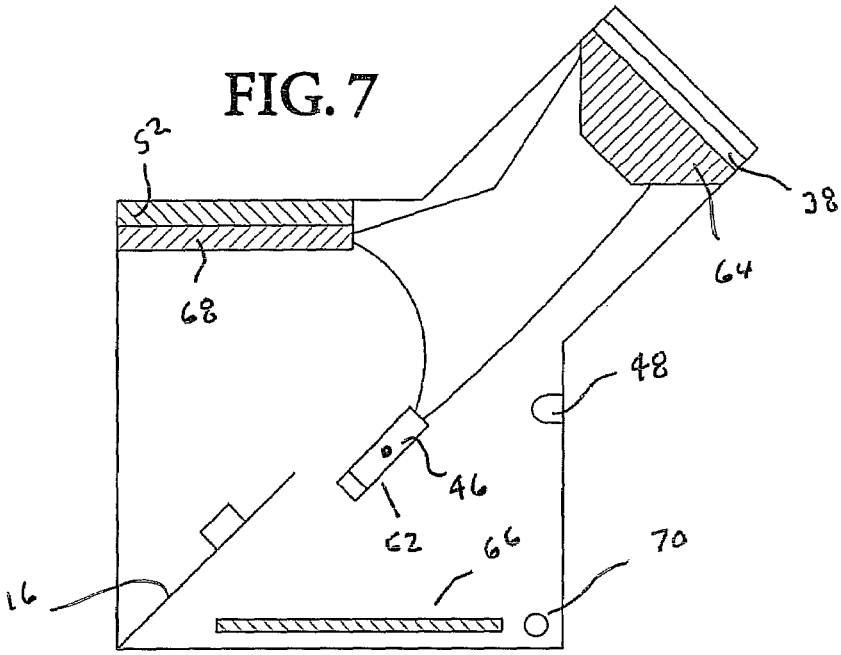
FIG. 7 is a diagrammatic side sectional view of an alternative construction using an electronic optical system.

As an alternative to an optical system using only mirrors and/or prisms, an optical system employing electronic components may be employed, as depicted in FIG. 7. As shown therein, mirror 66 reflects the image of card 16, which is received by miniaturized image sensor array as known in the art mounted above the mirror. The array is provided with adjustment means as again exemplified by rotation axis 46, allowing the angular orientation of the sensor to be adjusted to receive a proper image from mirror 66. The image formed on the sensor is displayed on display monitor 64 positioned behind viewing window 38. Wires interconnect the sensor and monitor and controller unit 68, which provides the required image transmission and processing power for the system, and which may be located adjacent circuitry means 52. A power jack 70 may be provided to allow an external power source, such as a battery pack, to be connected to the controller unit through an appropriate cable (not shown) and therethrough to the sensor and monitor as needed. The jack 70 can also be used to provide power to the illumination system, and thus may also be coupled to circuitry means 52.

Figure 8:
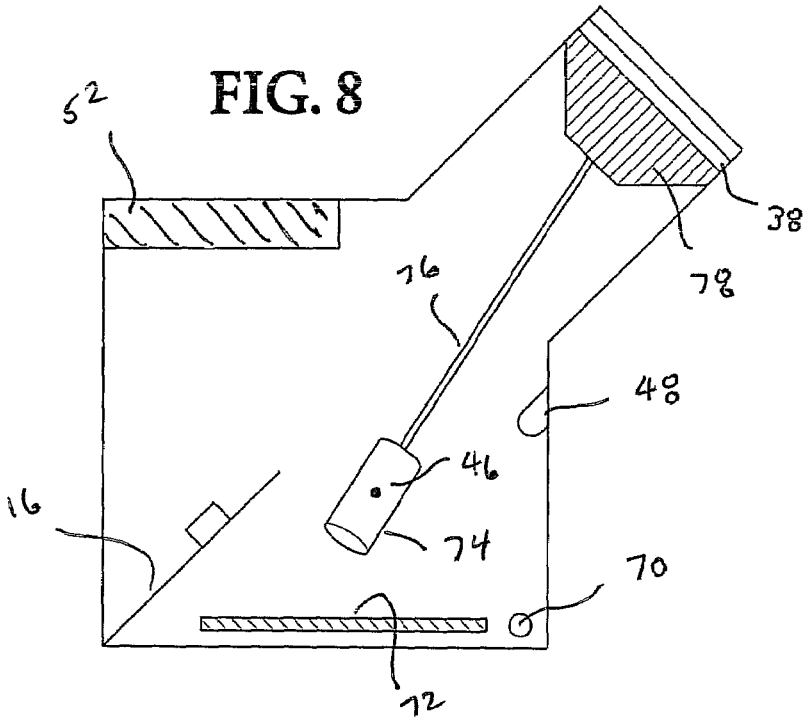
FIG. 8 is a diagrammatic side sectional view of an alternative construction using a fiber optic system.

FIG. 8 depicts yet another alternative embodiment for the invention, in which a first mirror 72 reflects the card image for receipt by lens system 74 which directs the image into fiber optic bundle 76 which in turn transmits the image to display 78. Display 78 may be passive in nature, having suitable lenses to allow viewing of the image transmitted by the fiber optic bundle, or may be electronic in nature, providing for amplification of the image and display on a screen. Power jack 70 can be utilized to provide the needed power in the event the display requires electric energy.

I claim:

1. A card viewing device for cards resting on a playing surface, comprising a housing having opposed first and second side walls, opposed front and rear walls, a card-accepting entranceway in a lower portion of the front wall, a viewing window in an upper portion of the rear wall, and an optical system within the housing for projecting an image of a portion of at least one card received within the device through the entranceway through the viewing window for observation by a user, the entranceway having an upwardly directed ramp surface extending from a bottom surface of the housing for elevating a forward portion of the at least one card while a rear portion of the at least one card remains on the playing surface to position the forward portion of the card for viewing through the optical system.

2. The card viewer of claim 1, wherein the upwardly directed ramp surface extends from the first side wall of the housing.

3. The card viewer of claim 1, wherein the entranceway further includes a card edge guide surface formed by the second side wall of the housing.

4. The card viewer of claim 3 wherein the optical system includes means for reorienting the image as it passes through the optical system.

5. The card viewer of claim 4 wherein the optical system includes a mirror or a prism.

6. The card viewer of claim 1 further comprising a light source to illuminate the portion of the at least one card received within the device.

7. The card viewer of claim 6 further including means for activating the illumination means upon receipt of a card portion within the device.

8. The card viewer of claim 7 wherein the activating means includes a timer.

9. The card viewer of claim 1 wherein the housing further includes a viewing collar extending outwardly from and surrounding the viewing window.

10. The card viewer of claim 1 wherein the viewing window is recessed within the first and second side walls, portions of the side walls forming view blocking means for the viewing window.

11. The card viewer of claim 1 wherein the viewing window includes means for limiting off-axis light transmission.

12. The card viewer of claim 1 further including means for adjusting the orientation of at least one element of the optical system to vary the angle of the image projected through the viewing window.

13. The card viewer of claim 1 wherein the optical system includes an electronic image sensor and a display.

14. The card viewer of claim 1 wherein the optical system includes a fiber optic bundle.

* * * * *